US009240099B2

(12) United States Patent
Trotter et al.

(10) Patent No.: US 9,240,099 B2
(45) Date of Patent: Jan. 19, 2016

(54) GAME OUTCOME VALIDATOR

(71) Applicant: WMS GAMING, INC., Waukegan, IL (US)

(72) Inventors: Paul Trotter, Buffalo Grove, IL (US); Saji Lazar, Des Plaines, IL (US); Joshuah Jacob, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 218 days.

(21) Appl. No.: 14/076,444

(22) Filed: Nov. 11, 2013

(65) Prior Publication Data

US 2015/0133210 A1 May 14, 2015

(51) Int. Cl.
*A63F 9/24* (2006.01)
*G07F 17/32* (2006.01)

(52) U.S. Cl.
CPC ..... *G07F 17/3241* (2013.01)

(58) Field of Classification Search
CPC ..... G07F 17/32
See application file for complete search history.

(56) References Cited

U.S. PATENT DOCUMENTS

| | | | |
|---|---|---|---|
| 7,780,529 | B2 | 8/2010 | Rowe et al. |
| 8,323,109 | B2 | 12/2012 | Carr-Greg |
| 2013/0137498 | A1 | 5/2013 | Willyard |

*Primary Examiner* — Omkar Deodhar
(74) *Attorney, Agent, or Firm* — Miller, Matthias & Hull LLP

(57) ABSTRACT

A simulator reproduces a game running on an electronic gaming machine using a model that implements the game rules and logic of the game. The electronic gaming machine stops at predetermined breakpoints during execution of a game session and sends data to the simulator at each breakpoint and at a conclusion of the game session. The data may include random number values, other game variables, and the result of the game session. The simulator uses the data to independently reproduce the game session. Output from the simulator is used to verify the state of internal variables and/or the result received from the electronic gaming machine.

18 Claims, 6 Drawing Sheets

280

Validation Test

282

Source Breakpoints_Demo.txt
Breakpoint 1 at 9x8d6e49e: file bld/gameautoplayfortesting.cpp, line 28
Breakpoint 2 at 9x8d6e49e: file bld/gameautoplayfortesting.cpp, line 28
Breakpoint 3 at 9x8d6e49e: file bld/gameautoplayfortesting.cpp, line 28
Breakpoint 4 at 9x8d6e49e: file bld/gameautoplayfortesting.cpp, line 28
Source_GiantsGold.txt

284

**********
** Giants_Gold_100L_85
**
** 1) Starting validation test
**
**********

286

. V 1 | BP2: .read betPerLine = 19 .set numPaylines = 2
. V 1 | BP8: .read randWeight = 203
. V 1 | BP3: .read BPtestStops = {29, 160, 163, 20, 51, 59, 170, 103, 41, 115}
[…]
. Validation test 1:
. Expected Value: 1235
. Reported Value: 0
* Validation 1 FAILED *

288

. V 2 | BP2: .read betPerLine = 20 .set numPaylines = 2
. V 2 | BP8: .read randWeight = 295
. V 2 | BP3: .read BPtestStops = {15, 110, 153, 36, 51, 75, 180, 4, 95, 136}
[…]
. Validation test 2:
. Expected Value: 5580
. Reported Value: 5580
* Validation 2 PASSED *

Fig. 4

GAME OUTCOME VALIDATOR

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE DISCLOSURE

The present disclosure relates generally to gaming systems and methods, and more particularly to an independent game outcome validator.

BACKGROUND OF THE DISCLOSURE

Gaming machines, such as slot machines, video poker machines, and the like, have been a cornerstone of the gaming industry for many years. However, confirming correct operation of a gaming machine is difficult because the number of play scenarios is virtually limitless and the actual payouts are a function of chance. While each game is extensively tested, Monte Carlo tests do not necessarily reflect actual game play and the associated sequences of events that may occur in use on a gaming floor.

In a gaming floor environment, game play history may be recorded but typically only covers tens of games. When a game is suspected of having a flaw, such as overpayment, it is difficult to prove whether the game is actually performing correctly. As the popularity of such games has increased, the need to refresh games more frequently has become the nature of the industry. This high turnover can add to an operator or owner questions about a certain machine or class of machines and whether it is operating correctly and more particularly, paying correctly.

SUMMARY OF THE DISCLOSURE

According to an aspect of the disclosure, a method of validating an outcome of an electronic gaming machine at a validation computer may use a processor, a memory, and a network interface at the validation computer to receive, from the electronic gaming machine, a signal containing game data generated at the electronic gaming machine. The game data may be generated responsive to play of a game at the electronic gaming machine by a human operator. The method may also include executing, at the processor of the validation computer, a model of the electronic gaming machine that uses the game data received from the electronic gaming machine to simulate operation of the electronic gaming machine. The validation computer may receive, from the electronic gaming machine, another signal containing a result responsive to further playing of the game at the electronic gaming machine. The method may then determine that the result received from the electronic gaming machine matches a simulation result generated at the validation computer responsive to execution of the model using the game data.

According to another aspect of the disclosure, an electronic gaming machine validation system may include an electronic gaming machine having a processor, memory, and a user interface. The electronic gaming machine may be programmed with game logic and rules to implement a game, and may be configured to operate in a debug mode that reports one or more of random number values, game variables, and a result associated with playing the game. The system may also include a validation computer that includes a physical memory and a processor that stores and executes software modules. The modules may include a communication module that receives the random number values, game variables, and the result from the electronic gaming machine, a model of the electronic gaming machine programmed with logic and rules that reproduces the game logic and rules of the electronic gaming machine, and a simulator that executes the model using the random number values and game variables received from the electronic gaming machine to produce a test result. The validation computer may also include a validation module that compares the result from the electronic gaming machine to the test result and an output module that logs information from the validation module.

According to yet another aspect of the disclosure, a simulator for validating results from an electronic gaming machine may be embodied on a computing platform including a physical memory and a processor that store and execute software modules on the processor that cause the simulator to execute, on the processor, a model having game rules and logic that reproduces a session of a game executing on the electronic gaming machine. The simulator may further i) pause execution of the model at a pre-determined breakpoint pending receipt of data from the electronic gaming machine, ii) receive, from the electronic gaming machine, the data corresponding to a current state of the electronic gaming machine, the data including at least one of a random number value, a game variable, and a result, and iii) continue execution of the model. The elements i, ii, and iii may be repeated until completion of the session of the game to produce a test result. The test result may be compared to the result received from the electronic gaming machine. An incident may be logged when the result from the electronic gaming machine fails to match the test result.

BRIEF DESCRIPTION OF THE DRAWINGS

FIG. 4 is a simulated screen shot of a transcript of a multi-pass software validation run;

Figure 1:
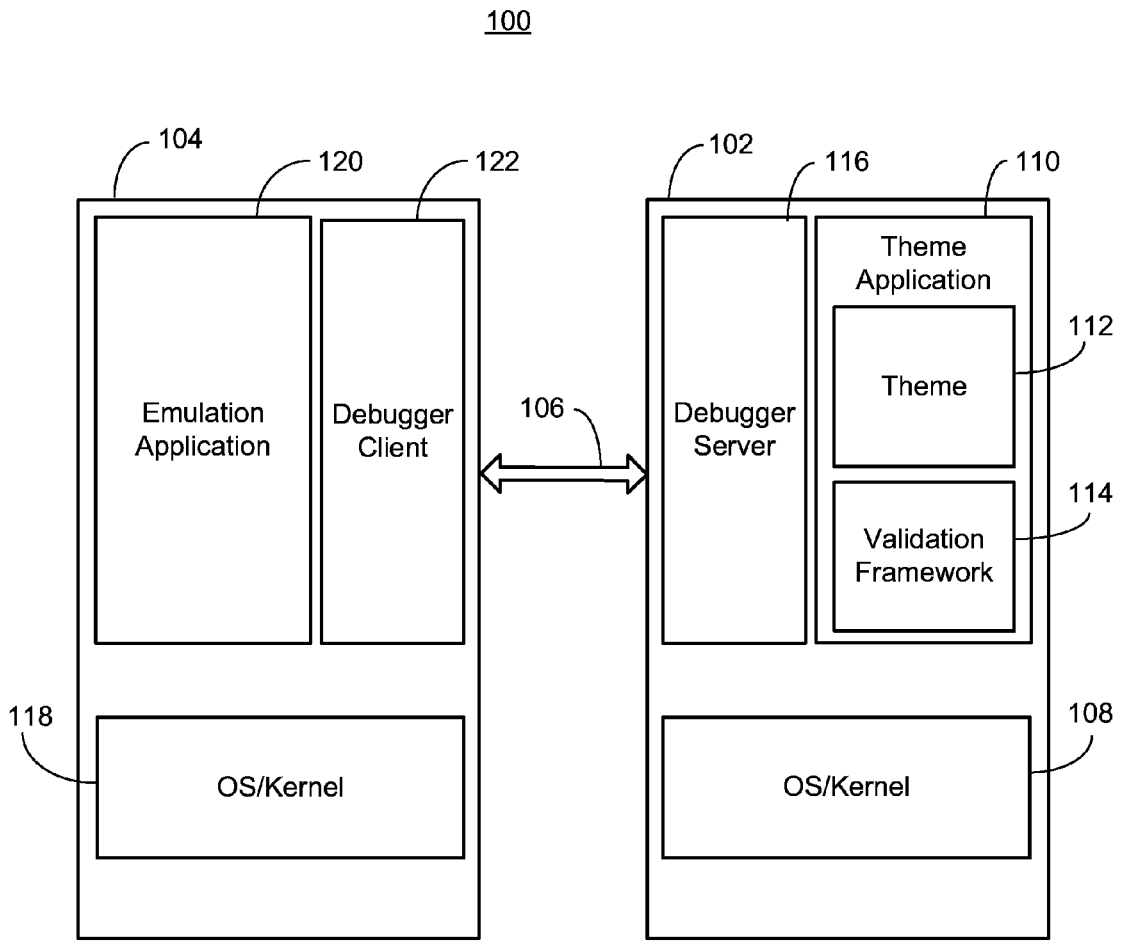
FIG. 1 is a block diagram that illustrates an exemplary system supporting game validation.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the appended claims.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts. While the present disclosure may be embodied in many different forms, the embodiments set forth in the present disclosure are to be considered as exemplifications of the principles of the present disclosure and are not intended to be limited to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

As discussed above, validation testing of a game in an electronic gaming machine can be labor-intensive and time-consuming. The possible combinations and permutations of symbols in a progressive-style gaming machine can run well into the thousands. Further, a particular model of electronic gaming machine may be installed in locations having different regulations and/or operator goals so that there may often be 70-150 paytables per model. Therefore exhaustive testing of every combination of symbols and payouts may not be possible even apart from the desire of manufacturers and operators to put new machines into operation as quickly as possible. The described system and associated method uses an independent validator to take data generated at an electronic gaming machine so that a comparison of results between the independent validator and the electronic gaming machine can be performed in real time. The ability to monitor and validate electronic gaming machines in real time as the game is played by a human operator provides another way of reassuring operators, regulators, and even to some extent, end users, that the game meets its operating requirements.

FIG. 1 is a block diagram that illustrates an exemplary electronic gaming machine validation system 100 supporting independent software validation for an electronic gaming machine 102. The electronic gaming machine 102 may be connected to a validation computer 104 via a network 106, such as, but not limited to, an IP network. The electronic gaming machine 102 is illustrated at a high level showing operating system 108 and a theme application 110 that may include a game theme 112, or a software program that effects game play, as well as a validation framework 114. The validation framework 114 may expose breakpoints during game execution when operating with a special diagnostic binary input output system (BIOS). The validation framework 114 may further support setting internal variables and/or reporting internal status at breakpoints. The electronic gaming machine 102 may also include a debugger server 116 that is active during operation under the diagnostic BIOS. The debugger server 116 may manage communications with a debugger client 122 operating on the validation computer 104. Because the electronic gaming machine 102 may be passive with respect to the validation operations, the construct of a server is useful in that the debugger server 116 may wait for inbound traffic from the debugger client 122. However, other constructs may be used instead of the client/server model, such as peer-to-peer connections or RPC calls. Additional details with respect to the electronic gaming machine 102 are discussed below with respect to FIG. 2.

The validation computer 104 may include an operating system 118, an emulation application 120, and the debugger client 122. In an embodiment, the operating system 118 may be a Linux operating system, although other known operating systems are capable of supporting the functions associated with the emulation application 120 and the debugger client 122. The emulation application 120 manages operator interaction, validation processing, and communication management with the electronic gaming machine 102 via the debugger client 122. The validation computer 104 and, more particularly, the emulation application 120 are discussed in more detail below with respect to FIG. 3.

Figure 2:
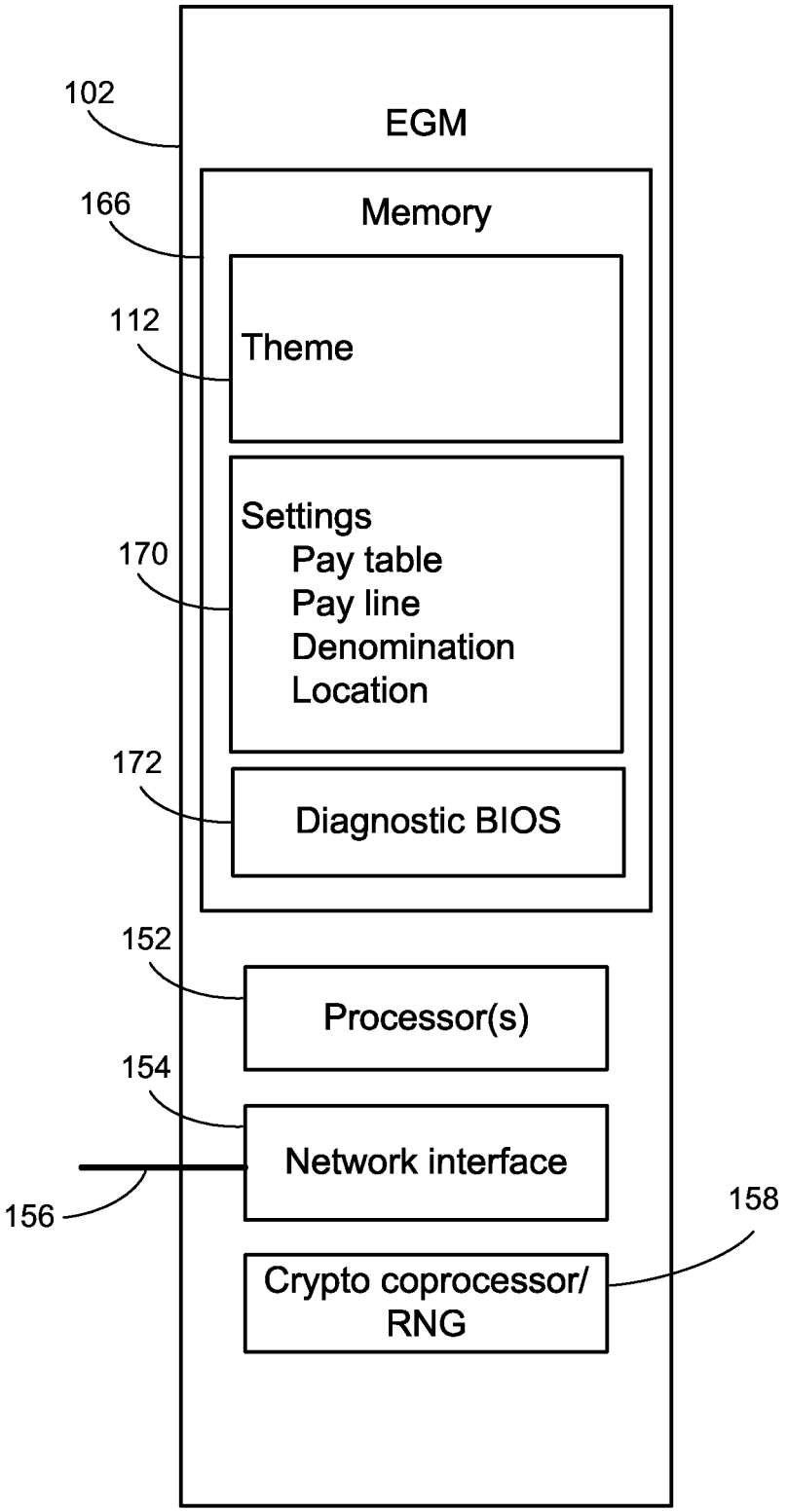
FIG. 2 is a block diagram that illustrates particular elements of an electronic gaming machine relevant to game validation.

FIG. 2 is a block diagram that illustrates particular elements of an electronic gaming machine 102 relevant to electronic gaming machine game validation. The electronic gaming machine 102 may include a processor 152 and a network interface 154 communicating via a data network 156. The electronic gaming machine 102 may also include a cryptographic coprocessor 158 that typically includes a random number generator (RNG) (not depicted).

The EGM 102 may also include a memory 166 that uses one or more physical memory devices capable of volatile and non-volatile data storage, at least some of which may be removable. In one embodiment, the memory 166 may include a game theme 112. Settings information 170 may include paytable information, pay line information, currency denomination, physical geographic location, etc. As shown in FIG. 1, the memory 166 may also include a validation framework 114, which is not shown for simplicity. The memory 166 may also include a diagnostic BIOS 172 that is used during game validation testing. The diagnostic BIOS 172 is often stored in a removable memory and may be required for activation of features in the validation framework 114 portion of the theme application 110 as well as providing communication support to the validation computer 104 during validation testing.

Figure 3:
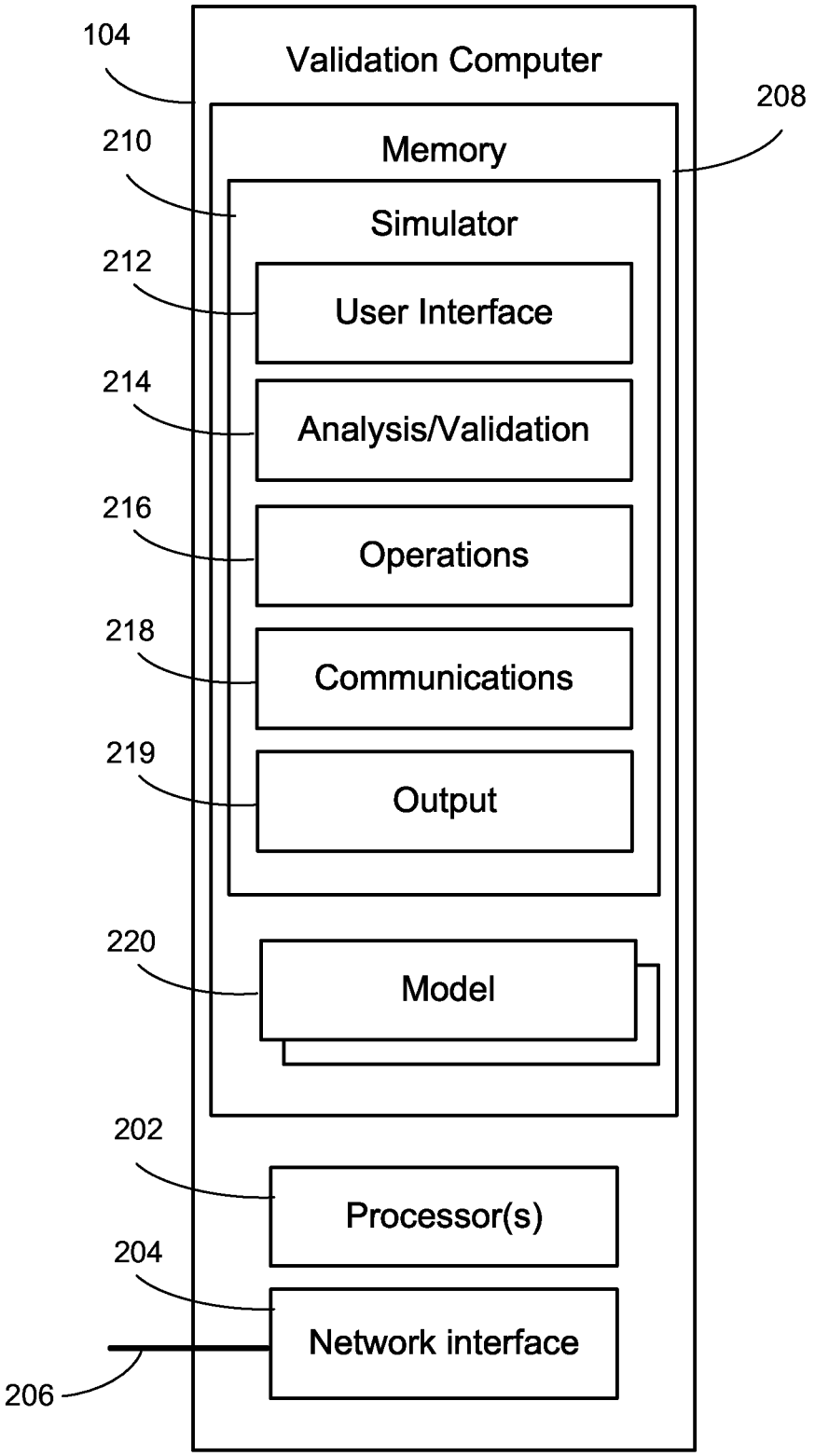
FIG. 3 is a block diagram that illustrates particular elements of a validation computer used for game validation.

FIG. 3 is a block diagram that illustrates particular elements of a validation computer 104. The validation computer 104 may be the same as or similar to the validation computer 104 of FIG. 1. The validation computer 104 may include a processor 202, a network interface 204 that supports communication via a data network 206. The validation computer 104 may also include a memory 208 storing, among other things, a simulator application 210. The simulator application 210 may include a user interface 212, an analysis and validation module 214 and an operations module 216, for example, that manages background processes and error conditions. The simulator application 210 may also include a communications module 218 for communication via the data network 206 or with the user interface 212. In an embodiment, the user interface 212 may be used to initialize a test sequence and view results, as well as monitor test progress. An output module 219 may set events, send messages, and/or log data from a validation test. The output module 219 may also generate a script from log data. The script may be used to drive a test sequence using the same data generated by the electronic gaming machine 102 and transmitted to the validation computer 104 during a validation run, as discussed in more detail below.

The memory 208 may also include a model 220 that may be one of several models available for use. The model 220 may contain the game logic and rules for a specific electronic gaming machine 102, or more specifically, for a particular game theme 112 running on the electronic gaming machine 102. The model 220 may be independently developed and coded so that it reproduces the game logic and rules of the game theme 112, but is not simply a copy of that code. The model 220 may have other uses for Monte Carlo testing and other evaluations because it may not include many of the user interface and other overhead features associated with the game theme 112.

The model 220 may also include game theme-specific settings for use in performing the validation test with a specific electronic gaming machine, such as, but not limited to, communication protocols, debug mode breakpoint settings, variables to monitor and report during validation testing, etc.

While the exemplary embodiment discussed above shows the model running on a separate computer connected by a data network, the model may also run on the same computing platform as the electronic gaming machine 102 and its associated game theme 112, either on a separate board, or actually sharing the processor and memory with the game theme 112.

FIG. 4 illustrates an exemplary view 280 of information associated with a validation test. The view 280 may be associated with setup and result data associated with a particular validation test. The breakpoints 282 may illustrate one set of breakpoints used at the electronic gaming machine to stop execution of a live game session at a particular point so that data can be passed from the electronic gaming machine 102 to the validation computer 104.

Information 284 specific to a game theme 112 may be presented or stored with test results 286 and 288. The test result 286 illustrates that a result from the electronic gaming machine 102 does not match a corresponding result generated at the validation computer 104 by the model 220. In contrast, test result 288 illustrates that the expected and reported values or results match and the validation is successful. In various embodiments, more or less data may be stored. For example, in one embodiment, all data transmitted from the electronic gaming machine 102 and all intermediate results calculated at the validation computer 104 may be stored. In another embodiment, only failed status results may be stored.

Figure 5:
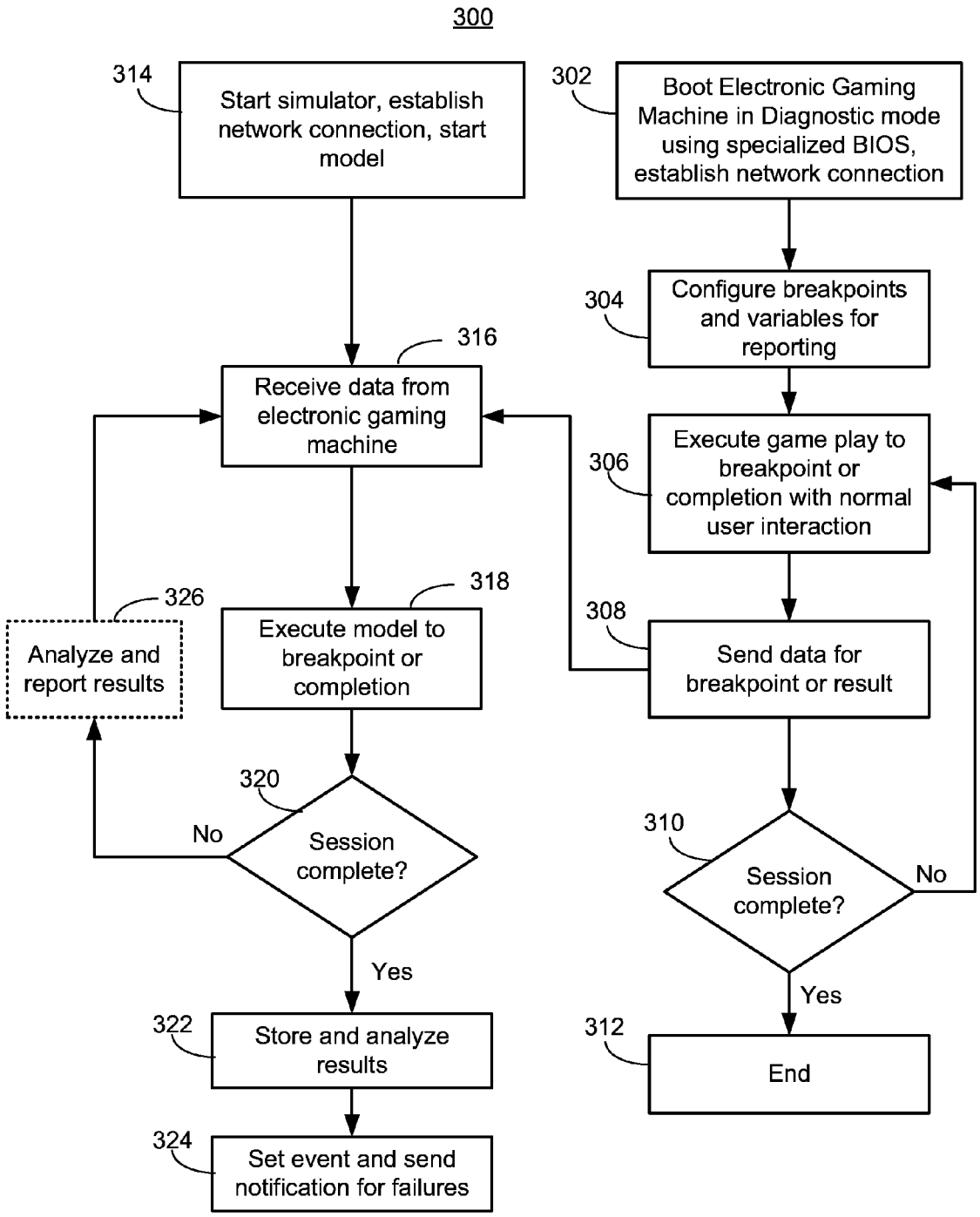
FIG. 5 is flowchart of a method of performing game validation testing for an electronic gaming machine.

FIG. 5 illustrates a method 300 of performing an independent validation of a game theme executing on an electronic gaming machine 102 by a validation computer 104. Activity at an electronic gaming machine 102 is discussed with respect to blocks 302-312. At a block 302, the electronic gaming machine 102 may be booted into a diagnostic mode using a specialized binary input/output structure (BIOS) 172. In this mode, external communication with the validation computer 104 may be supported and a network connection 106 with the validation computer 104 may be established.

At a block 304, breakpoints for the code of a game theme 112 may be configured via an application program interface (API). System variables of interest at a particular breakpoint may also be identified. These variables, including random numbers, may be transmitted to the validation computer 104 when that breakpoint is reached. The API may accept programming information from the validation computer 104 or may locally available for the purpose of supporting the validation test.

At a block 306, the game theme 112 may be executed in a normal fashion, for example, with a human player interacting normally with a user interface of the electronic gaming machine 102. The game theme 112 may execute until one of the breakpoints set at block 304 is reached. In an embodiment, this is after a reel spin that causes a one or more random numbers to be generated and used by game logic and rules to determine an outcome or result. In some cases, the result is immediate, in other cases, the result may be a continuation of the session via a bonus game or the like.

At a block 308, while execution is suspended at the current breakpoint the electronic gaming machine 102 may send the validation computer 104 the random number or numbers, and those game theme variables relevant to the game session as defined at block 304, and a result, if any.

At block 310, a determination is made if the current game session is complete. If so, the game session ends at block 312. If, at block 310, the game session is not complete, the process continues at block 306.

Activity at the validation computer 104 is described with respect to blocks 314-324. At a block 314, the validation computer 104 may execute the simulator application from code stored in the physical memory 208 of the validation computer 104. A network connection 106 with the electronic gaming machine 102 may be established to allow communication between the two devices. The model 220 may also be started and run to a first breakpoint.

At a block 316, data from the electronic gaming machine 102 may be received and used to drive the model 220. The data may include not only random number values, but may also include other information such as payline, bonus status, etc. Execution may continue at block 318 where the data from the electronic gaming machine 102 is used to run the model 220 to another breakpoint or to completion. A breakpoint for the model 220 generally corresponds to a point in the game logic and rules corresponding to a breakpoint at a similar execution point of the game logic and rules being executed by the game theme 112 running at the electronic gaming machine 102. In an embodiment, breakpoints may be placed at each independent event during game play, such as a user interaction at the electronic gaming machine 102, that is, pulling a handle, selecting a play button, etc., or after a result generated by such an action. In another embodiment, breakpoints may be set at those events that provide feedback to the user, such as payouts, a bonus game being activated, or a no-pay conclusion of the game session. A game session, for the purpose of this disclosure, may be defined either as an action/result pair, or as wager to payout or wager to loss series of actions. An action/result pair may be a user action that causes a visible change of state of the electronic gaming machine 102 at the user interface. A wager to payout or wager to loss is relatively self-explanatory, that is, until either the game returns value to the player or the players wager is forfeit. Therefore, data transferred will drive the model 220 in similar fashion to the operation of the game theme 112.

At a block 320, if the game session is complete, execution may continue at a block 322 where the result generated by the model 220 and the result received from the electronic gaming machine 102 may be stored and analyzed. In some embodiments, other intermediate data, such as game variables may also be stored and analyzed.

At a block 324, when the analysis shows that the result generated by the model 220 and the result received from the electronic gaming machine 102, or intermediate values if tested, do not match, an event may be set and a notification of the failure may be sent to an operator or other authority. In various embodiments, setting the event may cause the relevant data to be stored while if the event is not set the simulation and actual game data may be discarded. Alternatively, all data may be stored for each run. The notification may be in any suitable form, including, but not limited to, an email, a system alarm, a database entry, or other known mechanisms.

If, at block 320, the game session is not complete, execution may continue at a block 316 and the simulator application 210 may wait at the current breakpoint for additional data from the electronic gaming machine 102. The process may continue until the game session reaches a conclusion.

Optionally, at a block 326, the data received from the electronic gaming machine 102 may be logged, analyzed, or both and evaluated for correctness to the corresponding data generated by the model 220. In response to a failed test, the electronic gaming machine 102 may be removed from commercial service or may be withdrawn from testing, depending on the current state of the electronic gaming machine with respect to development, certification, and production use. While the illustrated embodiment is described in terms of a real time data transfer between the electronic gaming machine 102 and the validation computer 104, in an embodiment, the data captured at each breakpoint may be stored and transmitted in a batch after a result is generated, or at a later time based on local factors.

In an embodiment, all the data transmitted to the validation computer 104 from the electronic gaming machine 102 may be recorded and used to generate a test script that can be played back during subsequent testing operations. For example, if a validation fails, the exact sequence of events that caused the failure can be stored and played back to verify that a problem has been corrected. In order to accomplish this, an opposite process may be followed that injects into the electronic gaming machine 102 the random numbers and system variables captured from the previous trial run at the appropriate points of execution.

Figure 6:
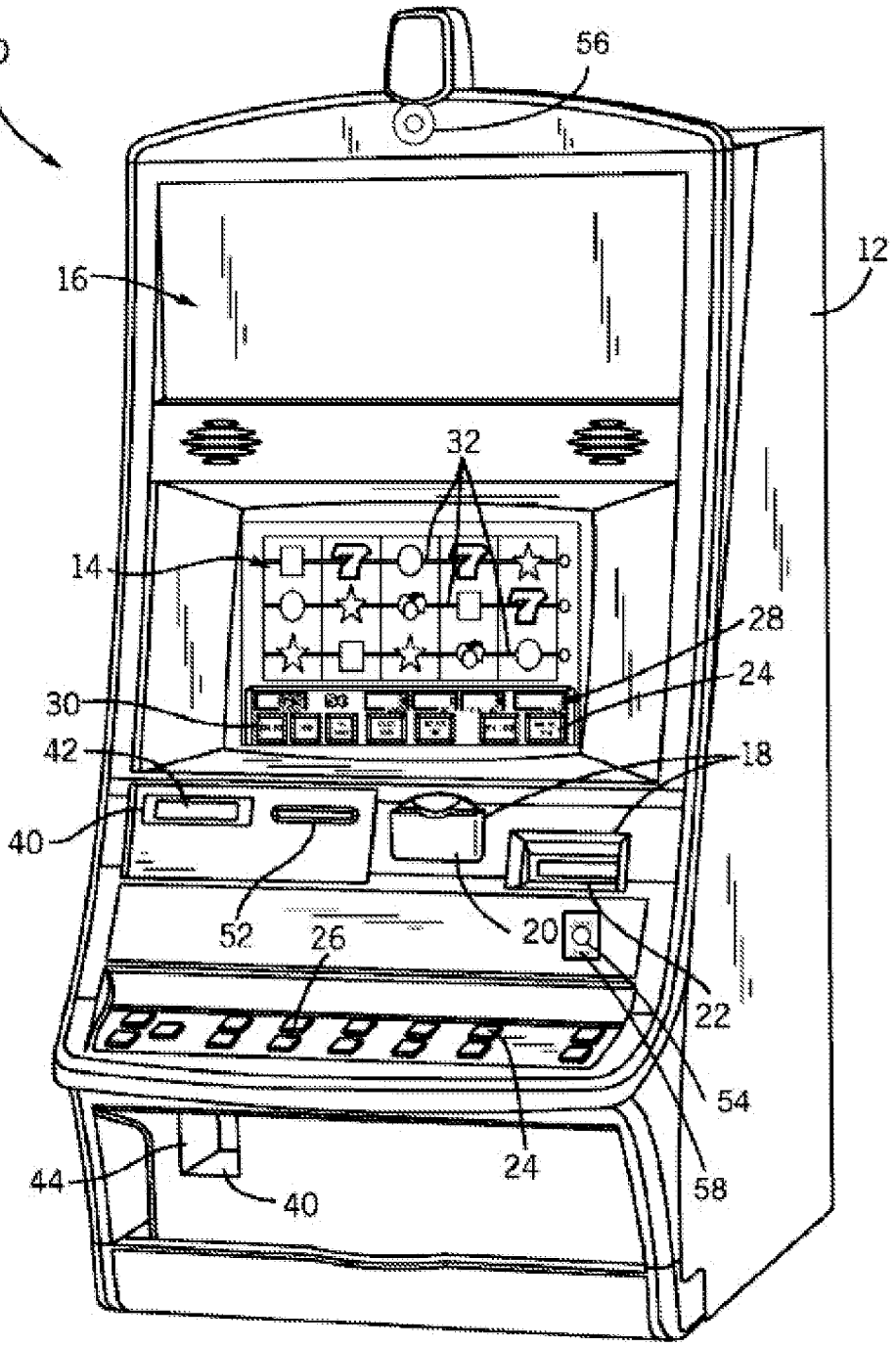
FIG. 6 is a perspective view of a gaming system according to an embodiment of the present disclosure.

FIG. 6 is a perspective view of a gaming machine 10 according to an embodiment of the present disclosure. The gaming machine 10 may be used in gaming establishments such as casinos. The gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as slots, keno, poker, blackjack, roulette, etc.

The gaming machine 10 may include a housing 12 and may include input devices, including a value input device 18 and a player input device 24. For output, the gaming machine 10 may include a primary display 14 for displaying information about the game theme 112, i.e., a basic wagering game. The primary display 14 may also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 may receive currency and/or credits that may be inserted by a player. The value input device 18 may include a coin acceptor 20 for receiving coin currency. Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 may include a plurality of push buttons 26 on a button panel for operating the gaming machine 10. In addition, or alternatively, the player input device 24 may include a touch screen 28 mounted by adhesive, tape, or the like over the primary display 14 and/or secondary display 16. The touch screen 28 may include soft touch keys 30 denoted by graphics on the underlying primary display 14 and may be used to operate the gaming machine 10. The touch screen 28 may provide players with an alternative method of input. A player may enable a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of operating the game, while the touch keys 30 may allow for input needed for another aspect of the game. In some embodiments, a physical player sensor 56 may also be included. The physical player sensor 56 may be a camera or a biometric sensor or a motion detecting device. The physical player sensor 56 may be used to provide inputs to the game, such as images, selection motions, biometric data and other physical information.

The various components of the gaming machine 10 may be connected directly to, or contained within, the housing 12, as seen in FIG. 6, or may be located outboard of the housing 12 and connected to the housing 12 via a variety of different wired or wireless connection methods. Thus, the gaming machine 10 may include these components whether housed in the housing 12, or outboard of the housing 12 and connected remotely. As discussed above, these wired or wireless connections may be used to communicate accessory information or may be used on a temporary basis to transfer update information.

The operation of the basic wagering game may be displayed to the player on the primary display 14. The primary display 14 may also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 may include the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 may be slanted at about a thirty-degree angle toward the player of the gaming machine 10.

A player may begin play of the basic wagering game by making a wager via the value input device 18 of the gaming machine 10. A player may select play by using the player input device 24, via the buttons 26 or the touch screen keys 30. The basic game may include of a plurality of symbols arranged in an array, and may include at least one payline 32 that indicates one or more outcomes of the basic game. Such outcomes may be randomly selected in response to the wagering input by the player. At least one of the plurality of randomly-selected outcomes may be a start-bonus outcome, which may include any variations of symbols or symbol combinations triggering a bonus game.

In some embodiments, the gaming machine 10 may also include a player information reader 52 that allows for identification of a player by reading a card 54 with player information 58 indicating his or her true identity. The player information reader 52 is shown in FIG. 6 as a card reader, but may take on many forms including a ticket reader, bar code scanner, RFID transceiver or computer readable storage medium interface. Currently, player information 58 may be generally used by casinos for rewarding certain players with complimentary services or special offers. For example, a player may be enrolled in the gaming establishment's loyalty club and may be awarded certain complimentary services as that player collects points in his or her player-tracking account. The player may insert his or her card 54 into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to recall or restore game assets that the player achieved and saved during a previous game session either in the gaming establishment or on a separate computing device at a different location. Other embodiments of the gaming machine 10 are possible, such as a handheld or a mobile gaming machine (not depicted). While an embodiment of gaming machine configuration is described with respect to casino floor games, the equipment and method are equally applicable to handheld or mobile gaming machines for which validation of operation may be desired.

In summary, a model 220 of a game theme 112 of an electronic gaming machine 102 may be used to validate results of the game theme 112 by using data generated by actual game play at the electronic gaming machine 102. Data from the electronic gaming machine 102 may be transferred in real time to the validation computer 104 for use in driving the model 220. This independent validation can be done in test environments at a manufacturer, a regulator, or an owner/operator. The data from a test run, particularly one that causes a validation failure may be stored and used to drive a subsequent test of the electronic gaming machine 102 to verify that a problem that caused the failure has been corrected.

Each of these embodiments and obvious variations thereof is contemplated as falling within the spirit and scope of the present disclosure as defined and set forth in the following claims. Moreover, the present concepts expressly include any and all combinations and subcombinations of the preceding elements and aspects.

What is claimed:

1. An electronic gaming machine validation system, the validation system configured to receive at least one of random number values, game variables, or a result associated with playing a wagering game on an electronic gaming machine operating in a debug mode, the electronic gaming machine programmed with game logic and rules to implement the wagering game; the validation system comprising:

a computing platform separate from the gaming machine, the computing platform including:

a physical memory and a processor that stores and executes modules, respectively, the modules including:

a communication module that receives the random number values, game variables, and the result from the electronic gaming machine;

a model of the electronic gaming machine, the model programmed with logic and rules that independently reproduces the game logic and rules of the electronic gaming machine;

a simulator module that executes the model using the random number values and game variables received from the electronic gaming machine to produce a test result;

a validation module that compares the result from the electronic gaming machine to the test result; and an output module that logs information from the validation module.

2. The electronic gaming machine validation system of claim 1, wherein the simulator module further comprises:

a notification module that sends an electronic message when the validation module identifies that the result and the test result do not match.

3. The electronic gaming machine validation system of claim 1, wherein the output module generates a script based on the random number values, game variables, and the result received from the electronic gaming machine, the script allowing a game session to be replayed.

4. The electronic gaming machine validation system of claim 3, wherein the computing platform on which the simulator module operates is separate from the electronic gaming machine and receives the random number values, game variables, and the result from the electronic gaming machine via a network.

5. The electronic gaming machine validation system of claim 1, wherein the simulator module pauses execution of the model pending receipt of data from the electronic gaming machine.

6. A method of validating an outcome of an electronic gaming machine at a validation computer having a processor, a memory, and a network interface, the method comprising:

receiving, at the validation computer from the electronic gaming machine, a signal containing game data responsive to execution of a game at the electronic gaming machine;

developing a model executed at the validation computer, the model configured to independently reproduce game logic and rules of the game executing at the electronic gaming machine, the model being developed and coded independent from the electronic gaming machine;

executing, at the processor of the validation computer, the model of the electronic gaming machine using the game data;

receiving, at the validation computer from the electronic gaming machine, another signal containing a result responsive to further playing of the game at the electronic gaming machine;

determining that the result received from the electronic gaming machine matches a simulation result generated at the validation computer responsive to execution of the model using the game data; and validating the outcome of the electronic gaming machine when the simulation results matches the result received.

7. The method of claim 6, wherein the game data received from the electronic gaming machine includes a value of an internal variable of the electronic gaming machine, the method further comprising determining at the validation computer that the value of the internal variable matches an expected value of a corresponding variable generated at the validation computer.

8. The method of claim 6, further comprising generating a game execution script from the game data for use in electronic gaming machine testing.

9. The method of claim 6, wherein receiving the signal containing the game data comprises receiving the signal responsive to each game play event occurring at the electronic gaming machine.

10. The method of claim 9, wherein receiving the signal containing the game data comprises receiving the signal responsive to the electronic gaming machine reaching a pre-set breakpoint in the game executing on the electronic gaming machine.

11. The method of claim 6, further comprising setting the model to wait for data from the electronic gaming machine at an execution point of the model corresponding to the pre-set breakpoint on the electronic gaming machine.

12. The method of claim 6, further comprising logging events when the result fails to match the simulation result.

13. The method of claim 12, further comprising sending an electronic message when the result fails to match the simulation result.

14. A simulator for validating results from an electronic gaming machine, the simulator embodied on a computing platform separate from the gaming machine, the computing platform including a physical memory and a processor that stores and executes software modules on the processor that cause the simulator to:

execute, on the processor, a model of the electronic gaming machine, the model programmed with logic and rules that independently reproduces a session of a game executing on the electronic gaming machine;

i) pause execution of the model at a pre-determined breakpoint pending receipt of data from the electronic gaming machine;

ii) receive, from the electronic gaming machine, the data corresponding to a current state of the electronic gaming machine, the data including a random number value in at least one iteration, and at least one of a game variable or a result;

iii) continue execution of the model;

repeat i, ii, and iii until completion of the session of the game to produce a test result;

compare the result from the electronic gaming machine to the test result; and log an incident when the result from the electronic gaming machine fails to match the test result.

15. The simulator of claim 14, further comprising a software module that when executed by the processor causes the simulator to receive the data from the electronic gaming machine via a network connection.

16. The simulator of claim 14, further comprising a software module that when executed by the processor causes the simulator to send data to the electronic gaming machine with information corresponding to execution of the electronic gaming machine in a debug mode.

17. The simulator of claim 16, wherein the information includes breakpoint information and variable data to send to the simulator at each breakpoint.

18. The simulator of claim 14, further comprising a software module that when executed by the processor causes the simulator to generate a script of the data received from the electronic gaming machine for use in recreating the session of the game.

* * * * *